US005842253A

United States Patent [19]

Ahl et al.

[11] Patent Number: 5,842,253

[45] Date of Patent: Dec. 1, 1998

[54] LADDER SUPPORTED HOLDING TRAY FOR A PAINT ROLLER

[76] Inventors: Frank E. Ahl, Box 41; Brian E. Ahl, Box 154, both of Elliston, Mont. 59728

[21] Appl. No.: 757,755

[22] Filed: Nov. 26, 1996

[51] Int. Cl.[6] ..... B44D 3/12

[52] U.S. Cl. ..... 15/257.06; 182/129; 220/475; 220/751; 248/210; 248/238

[58] Field of Search ..... 15/257.05, 257.06; 182/129; 220/475, 478, 480, 751; 248/210, 211, 238

[56] References Cited

U.S. PATENT DOCUMENTS

| | | | |
|---|---|---|---|
| 2,415,289 | 2/1947 | Jury | 182/121 |
| 3,642,240 | 2/1972 | Hershey | 248/210 |
| 3,707,242 | 12/1972 | Golden et al. | 220/1 R |
| 3,731,840 | 5/1973 | Beutler et al. | 220/95 |
| 3,757,382 | 9/1973 | Jackson | 15/257.05 |
| 3,940,824 | 3/1976 | Gioia et al. | 15/257.06 |
| 4,205,411 | 6/1980 | Cupp et al. | 15/257.06 |
| 4,815,684 | 3/1989 | Kellstadt | 248/210 |
| 4,953,661 | 9/1990 | Hilton et al. | 182/120 |
| 5,052,581 | 10/1991 | Christ et al. | 220/520 |
| 5,079,752 | 1/1992 | Lemon et al. | 15/157.06 |
| 5,079,795 | 1/1992 | Schmid | 15/257.06 |
| 5,429,205 | 7/1995 | Collins | 182/172 |
| 5,493,751 | 2/1996 | Misiukoweec et al. | 15/257.06 |

FOREIGN PATENT DOCUMENTS

| | | | |
|---|---|---|---|
| 255180 | 1/1913 | Germany | 248/211 |

*Primary Examiner*—Mark Spisich
*Attorney, Agent, or Firm*—Jerry Johnson

[57] ABSTRACT

The ladder supported holding tray of the present invention comprises a tray assembly for releasable attachment to a step ladder or to an extension ladder that typically comprises an open top container including at least a front panel, a back panel, a first side panel, an second side panel, and a bottom joined together to define a hollow interior receptacle. First step engagement member are disposed on the container proximate the container bottom to permit secure temporary engagement of the tray to a first step of a step ladder, to a first single rung of an extension ladder, or to first side by side rungs of overlapping sections of an extension ladder. Second step engagement member are disposed on the tray assembly proximate to the open top of the container to permit secure temporary engagement to a second step of a step ladder, a second single rung of an extension ladder, or a second rung of side by side rungs of overlapping sections of an extension ladder. The second step engagement member contacts only the bottom surface of a second step or rung.

15 Claims, 3 Drawing Sheets

LADDER SUPPORTED HOLDING TRAY FOR A PAINT ROLLER

BACKGROUND

The present application is related to copending application Ser. No. 08/731,442 filed Oct. 15, 1996, entitled "Ladder Supported Holding Tray" by the same inventors as the present application. That application is incorporated herein by this reference.

Ladder supported holding trays suitable for holding hardware or paint have existed in various configurations. These trays typically utilize support members that permit temporary attachment of the tray to a step ladder or an extension ladder. A common problem associated with ladder supported holding trays is that such trays are specifically designed to attach to a single type of ladder. Furthermore, these ladder supported holding trays often only permit attachment to a specific configuration of step ladder or a specific configuration of extension ladder. As many variations of ladders exist in the marketplace there can be difficulty in finding a proper holding tray that the ladder will accommodate.

Another problem associated with typical ladder supported holding trays has been the attachment member utilized to secure the trays to a ladder. These trays typically require attachment either to two steps of a step ladder; to a step of a step ladder and the ladder rail; or to two spaced apart rungs or an extension ladder. Due to the variations in ladder construction, the supporting members of the trays often have to be adjusted when possible to securely attach the tray to a ladder. Where adjustment isn't possible often the tray cannot be utilized with particular ladders.

Existing ladder supported holding trays are often problematic to mount on a ladder because of the necessity to attach at more than one point on the ladder. Additionally, most ladder supported holding trays require the user to hold the tray with one hand, while attaching the tray to the ladder with a second hand. This is particularly difficult when the attachment member includes fasteners. It is both difficult and dangerous to devote both hands to mounting a holding tray to a ladder when the user is standing on the ladder. If the ladder supported holding tray mounts in a manner where the tray is not centered on the ladder but is cantilevered off the ladder and attaches to the ladder rail, the attachment process becomes even more difficult and dangerous. In an arrangement of this type the user must lean away from the ladder while holding the try while also fastening the tray to the ladder. Ladder supported holding trays of this type are also prone to destabilizing the ladder to which they are attached.

Existing tray designs that utilize a single step for attachment utilize a support on the tray which can be attached to a single rung or step and from which the tray hangs. A problem associated with this design is the lack of stability of a tray that can easily be accidentally moved in relation to the ladder. Furthermore, the support devices used to hang the tray are located above the tray container and often block access to the container portion of the tray. Tray supports of this type often do not have a secure attachment to the tray, as well, and allow the tray to swing in relation to the support if the support is used to carry the tray up or down the ladder.

An additional problem with existing ladder supporting trays is the instability of the holding tray when the trays are not in attachment to a ladder. Filling a tray with paint or other items is difficult as the user must somehow support the tray to do so. Use of a tray of this type when off the ladder is extremely restricted and often not even possible.

Still another problem with existing ladder supported holding trays is the absence of a suitable handle. Many trays do not have a handle and require the user to grab on to the tray wherever possible. This is problematic to the user who is required to both hold the tray while moving up and down the ladder, and to hold the tray while securing the tray to the ladder. Not finding an adequate area to hold on to the tray can be both difficult and dangerous to the user while moving the tray or securing it to the ladder.

Tray designs that do utilize a handle have problems associated with the use of the handle. Many handles also additionally serve as the support from which the tray hangs. In this design the handle is typically located above the tray and often obstructing the user from the tray itself. Furthermore, the tray is allowed to swing from a handle of this type which is typically non-fixed and pivots freely about the tray. The user in this case has to carefully keep the tray from swinging and losing the contents of the tray. Additionally, the user of a tray of this type has to mount the handle onto a step or rung and then somehow remove his or her hand from the handle once the handle is attached to the ladder.

Other tray designs that also include a handle make the handle only useful when moving up or down the ladder. The handle in these tray designs is often unusable during the mounting of the tray on the ladder. This requires the user to hold onto a different portion of the tray during securement of the tray to the ladder, a process which is both difficult and dangerous when standing atop a ladder.

Because of the aforementioned reasons there is a need for a ladder supported holding tray that securely and easily mounts and dismounts to different types of ladders; and, will securely mount to a step ladder, to an extension ladder when fully extended, or to an extension ladder in a position when the ladder section are overlapping. There is also a need for a ladder supported holding tray that allows the user to mount the tray with one hand only and includes no fasteners; and, includes no support member that will obstruct the user from accessing the container portion of the tray. There is a further need for a ladder supported holding tray that is self supporting when the tray is not attached to a ladder; and, provides a secure handle for easily holding the tray while moving the tray, or while securing the tray to a ladder, which does not interfere with utilizing the tray once mounted to a ladder.

SUMMARY

The tray assembly of the present invention satisfies all of the aforementioned needs for a ladder supported holding tray.

The ladder supported holding tray of the present invention comprises tray assemble for releasable attachment to a step ladder or to an extension ladder that typically comprises an open top container including at least a front panel, a back panel, a first side panel, an second side panel, and a bottom joined together to define a hollow interior receptacle. First step engagement member are disposed on the container proximate to the container bottom to permit secure temporary engagement of the tray to a first step of a step ladder, to a first single rung of an extension ladder, or to first side by side rungs of overlapping sections of an extension ladder. Second step engagement member are disposed on the tray assembly proximate to the open top of the container to permit secure temporary engagement to a second step of a step ladder, a second single rung of an extension ladder, or a second rung of side by side rungs of overlapping sections of an extension ladder. The second step engagement member contacts only the bottom surface of a second step or rung.

The tray assembly, once engaged to a step, positions the container bottom substantially proximate to that step and additionally positions the first step engagement means substantially below that step. The first step engagement member includes a flat bottom surface that is coplanar with the container bottom lower surface for providing then tray assembly stability when placed on a flat surface. The side panels and end panels typically include a top lip defining the upper rim of the open top container. The second step engagement means typically comprises tabs disposed on the top lip of both side panels for engaging the bottom surface of a second step.

The container bottom typically comprises at least a lower surface and an inclined rolling surface higher than the lower surface; wherein the lower surface is proximate to the bottom of the front panel; and, the rolling surface is proximate to the bottom of the back panel. The container above the lower surface and beneath the rolling surface defines a paint basin.

The first step engagement means typically comprises an upward sloping concave surface configured to releasably engage and securely hook onto a step from underneath the step. The first step engagement means typically originate at a position on the container proximate the center of the container bottom and extend therefrom to a position proximate the back panel of the container. The first step engagement means are typically separated from the container bottom by a step receiving recess defined by the gap between the container bottom and the upward sloping surface of the step engagement means, wherein the gap is slightly larger that the thickness of a step which is received into the recess for securely positioning the tray on that step.

The tray assembly typically additionally includes a tray handle disposed between the first and second side panels adjacent to the top lip of the side panels intermediate the front panel and the back panel. The tray handle typically also includes paint roller engagement means for engaging a handle of a paint roller that is disposed within the container. The paint roller engagement means comprise paint roller handle receiving slots on the tray handle that permit a paint roller handle to be temporarily secured to the tray.

The ladder supported tray assembly of the present invention includes new features providing benefits heretofore unrealized by prior art tray designs. A first benefit of the tray assembly of the present invention is the ability of the tray to be easily mounted to the many configurations of step ladders, or to extension ladders whether in a fully extended position or to the overlapping sections of the ladder when not fully extended. The user of the tray assembly needs only to choose which step or rungs to support the tray and then to slide the tray assembly onto those step or rungs. The tray assembly requires no fasteners or the manipulation of adjustable supports to mount it securely. The procedure for mounting the tray is extremely easy and requires just one hand allowing the user to maintain balance on the ladder by maintaining contact with the ladder with the other hand. The process for mounting the tray assembly to a ladder only requires a slight tilting of the tray to slide the step, rung, or set of rungs into the recess separating the step engagement means and the container bottom. As the tray is tilted back to a level condition, the second step engagement means comes into engagement with the next higher step or rung.

The first step engagement means include an upward sloping surface that is typically concave that allows the tray assembly to lock itself to the step or rungs to which it is engaged. Once engaged the upward sloping surface of the step engagement means prevent a lateral force from moving the tray in relation to the ladder. The tray assembly in mounting the container on top of a step, rung, or set of rungs while at the same time securing the tray with step engagement means that are beneath the step or set of rung is resistant to upward or downward forces, as well. The second step engagement means comprises a tab disposed on the top surface of the side panels of the tray adjacent to the back panel. The tabs are designed to engage the bottom surface of the next higher step or rung of the ladder.

If the ladder on which the tray is desired to be mounted comprises a step ladder or an extension ladder having adjacent side by side rungs of overlapping section of the extension ladder, the first step engagement means are sufficient to secure the tray to the ladder. However, the second step engagement means will typically engage the next higher step or rung and will assist in the securement of the tray to the ladder. If the ladder on which the tray is desired to be mounted is an extension ladder that is in an extended condition, the first step engagement means by themselves will not securely attach the tray to the single rung of the extension ladder. In this instance the second step engagement means provides the necessary extra engagement to the ladder to keep the tray from simply rotating on the rung. The position of the second step engagement means on the top of the side panels ensures that as the tray is rotated back to a level condition once the first step engagement means engages a first rung, the second step engagement means will engage the next higher rung of the ladder. The second step engagement means contacts only the bottom surface of the next higher step or rung. And, although ladders come in many configurations the dimension separating the top of one step or rung to the bottom of the next higher step or rung is fairly standardized and ensures the operability of the tray to most current step or extension ladder designs.

In addition, the tray assembly is easily removed from a ladder. The user must only tilt the tray to release the first and second step engagement means from the ladder while moving the tray assembly away from the ladder.

The tray assembly of the present invention includes the additional benefit of including no structural elements or support means s that would interfere with access to the container portion of the tray in use. The entire supporting structure of the tray assembly is located beneath the container and therefore no elements of the tray are adjacent to the container top. The supporting means s also provide a suitable structure for supporting the tray on a flat surface if the user desires to use the tray assembly away from a ladder.

A farther benefit of the tray assembly of the present invention is the provision of a handle attached to the tray. The handle provides a secure attachment point for the user, and allows the user to easily move with the tray up and down a ladder. The handle located between the two side panels of the tray does not obstruct the container top as many handles do. The handle which is fixed and non-pivoting does not permit the tray to swing and possibly spill the contents from the container during movement. The handle is further located close to the center of gravity of the entire tray assembly. This attachment location causes the entire tray assembly to be easily moved without the user having to resist the weight of the tray and its contents. The handle is also mounted on the tray in such a way that it does not interfere with mounting the tray to a ladder or removing the tray from the ladder. The ladder supported holding tray requires a minimum of materials to manufacture, and is durable in construction.

These and other advantages of the present invention will become apparent upon inspection of the accompanying specification, claims and drawings.

DRAWINGS

FIG. 3 additionally shows a paint roller supported within the ladder supported holding tray.

DESCRIPTION

Figure 1:
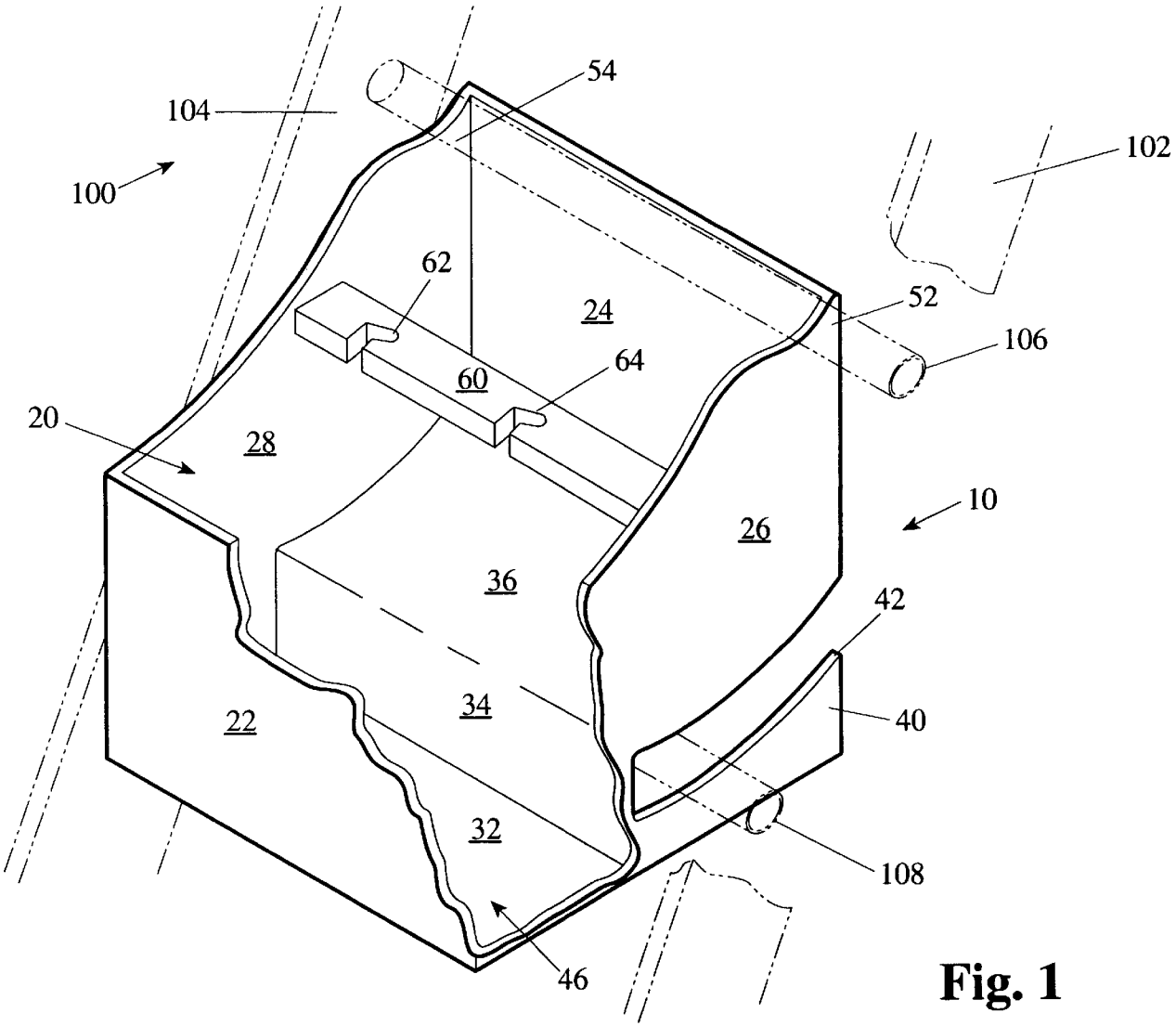
FIG. 1 is a perspective view of a preferred version of the ladder supported holding tray of the present invention attached to an extension ladder.
Figure 2:
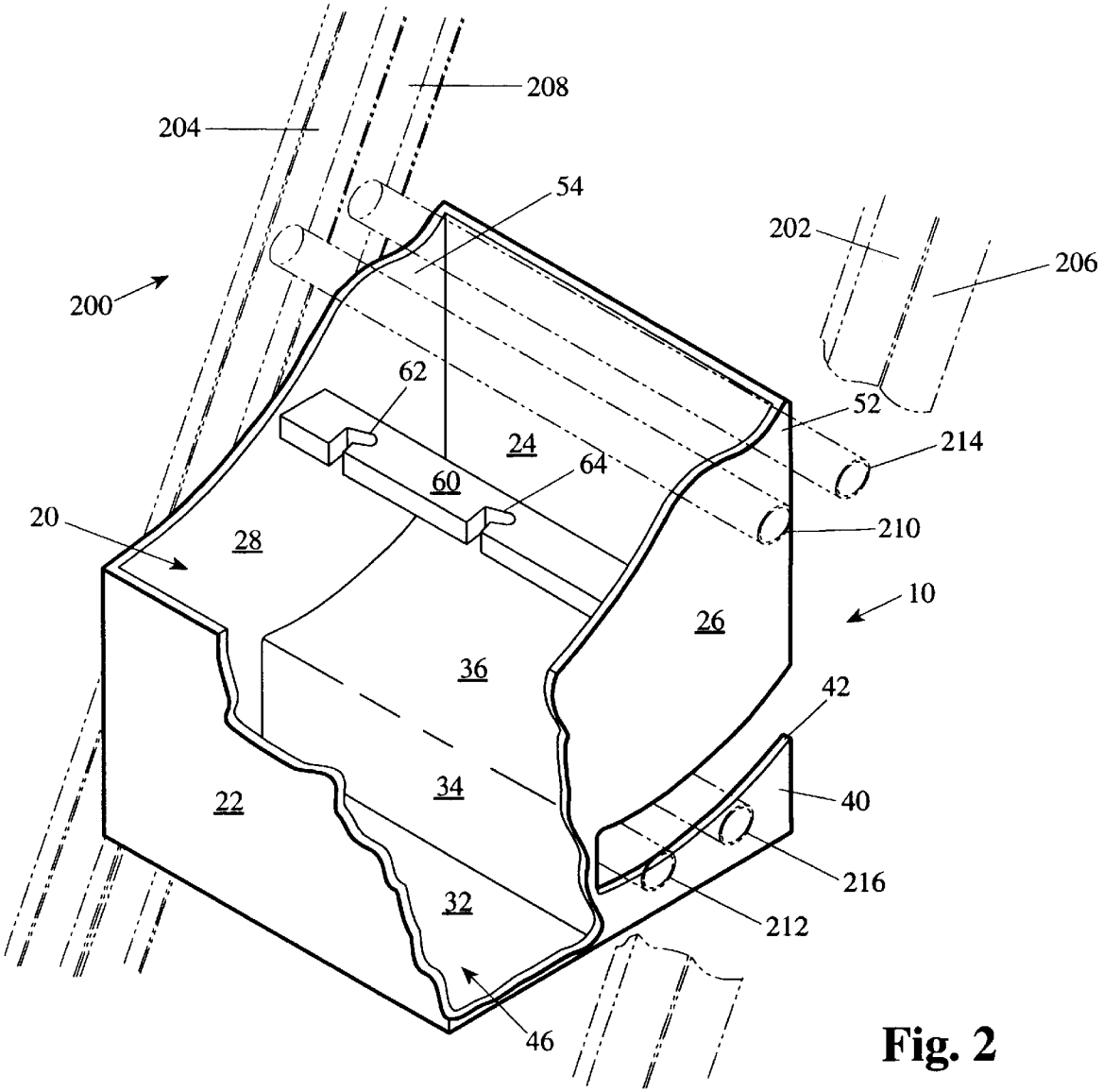
FIG. 2 is a perspective view of a preferred version of the ladder supported holding tray of the present invention attached to an extension ladder in a non-extended condition.
Figure 3:
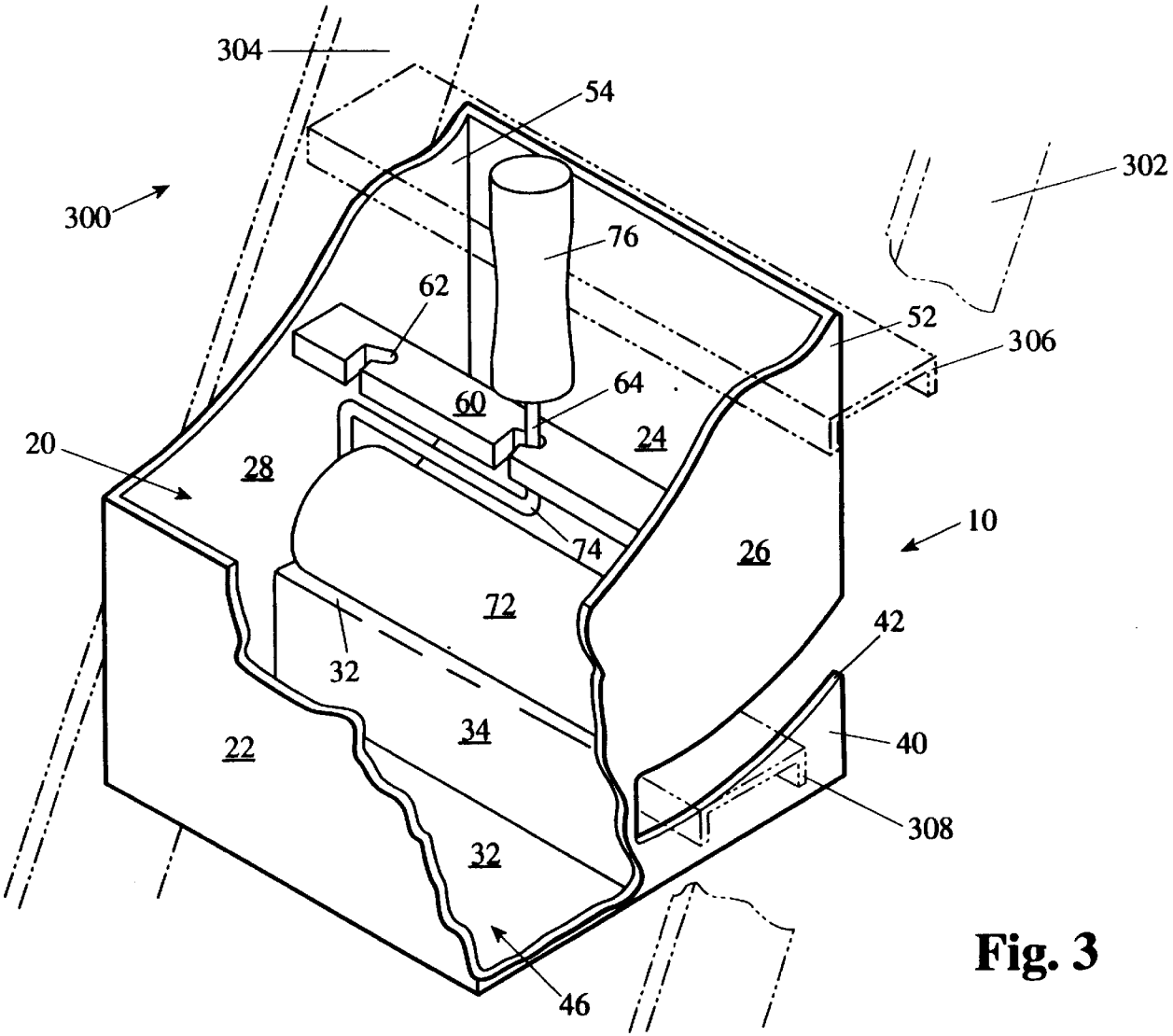
FIG. 3 is a perspective view of a version of the ladder supported holding tray of the present invention attached to a step ladder.

Referring in more detail to the drawings, there is illustrated in FIGS. 1 to 3 the releasable attachment of a preferred version of the ladder supported holding tray of the present invention to two types of ladders currently available on the market. FIG. 1 shows the ladder supported holding tray 10 attached to an extension ladder 100 that is in a fully extended condition. FIG. 2 shows the ladder supported holding tray 10 attached to an extension ladder 200 in a non-extended condition. FIG. 3 shows the ladder supported holding tray 10 attached to a step ladder 300 and also shows the inclusion of a paint roller mounted within the tray.

In greater detail, FIG. 1 shows the preferred version of the ladder supported holding tray 10, comprising an open top container shown generally at 20 which includes a first side panel 26, a second side panel 28, a front panel 22, a back panel 24, and a bottom. The top lip of the first and second side panels, the front panel, and the back panel define an upper rim of the open top container. The bottom includes a lower surface 32, an inclined rolling surface 36, and an upright bottom surface 34 that separates the lower surface 32 and the rolling surface 36 and is substantially at the center of the container bottom. The container interior beneath the rolling surface 36 defines a paint basin, which in the preferred version of the invention shown in FIGS. 1 to 3 is of a size to accommodate a paint roller.

Also shown in FIG. 1 is a first step engagement means 40 that is attached to the container bottom at the upright surface 34 and extends rearwardly therefrom to a position proximate the container back panel. The first step engagement means may typically be disposed beneath the first side panel 26 and formed integrally therewith. The first step engagement means 40 also includes a concave upward sloping surface 42. Concave upward sloping surface 42 is separated from the container bottom by a gap that defines a step receiving recess. The concave upward sloping surface 42 is configured to releasably engage and securely hook onto a step from underneath the step. Disposed within the step receiving recess is rung 108 of extension ladder 100. Not shown is an identical step engagement means disposed beneath the second side panel. The lower surface of the container bottom and the bottom of the step engagement means provide the tray with a continuous flat base for supporting the tray on a flat surface.

FIG. 1 also shows the first side panel 26 including a tab 52 disposed on the top lip of the first side panel. Second side panel 28 similarly includes tab 54 disposed on the top lip of that panel. Tabs 52 and 54 comprise the highest points on the side panels. These tabs 52 and 54 are disposed at a height to contact the bottom surface of a step which in FIG. 1 is the rung 106. Tabs 52 and 54 comprise the second step engagement means and once in contact with the bottom surface of rung 106 prevent the forward rotation of the tray 10 in relation to rung 108. The tray assembly of FIG. 1 contacts the extension ladder 100 only at rung 108 and the bottom surface or rung 106. The tray assembly of FIG. 1 is designed to rest atop rung 108 and rotate forward until contact is made by tabs 52 and 54 on the bottom of rung 106. The tray assembly is typically sized to fit between ladder side rails 102 and 104 without maintaining contact with the side rails.

Additionally shown in FIG. 1 is a handle 60 that is attached to the inside surface of the first and second side panels proximate to the top lip of the side panels. Handle 60 is disposed intermediate the two side panels and additionally includes paint roller engagement means which typically comprise paint roller handle receiving slots 62 and 64.

FIG. 2 shows the preferred version of the ladder supported holding means attached to adjacent side by side rungs of overlapping sections of extension ladder 200. Extension ladder 200 shown in a non-extended condition includes a first section that includes rails 202 and 204, as well as rungs 210 and 212. A second section includes rails 206 and 208, as well as rungs 214 and 216. The first step engagement means 40 of the ladder supported holding tray is shown engaging adjacent rungs 212 and 216. As such, rungs 212 and 216 are disposed within the step receiving recess defined by the gap between concave upward sloping surface 42 and the container bottom. Tabs 52 and 54 of the second step engaging means are shown engaging the bottom surface of rung 214. The first engagement means includes the concave upward sloping surface that is configured to releasably engage and securely hook onto a step from underneath the step. As shown in FIG. 2, the step comprises adjacent side by side rungs and in this case provide the first step engagement means with sufficient engagement surface for the first step engagement means to securely attach the tray to ladder 200. The engagement of the first step engagement means would provide a resistance to movement of the tray in all directions and would additionally prevent rotation of the tray in relation to the rungs 212 and 216. The tabs 52 and 54 that comprise the second step engagement means would provide an additional degree of securement of the tray to the ladder.

FIG. 3 shows the preferred version of the ladder supported holding tray of the present invention attached to a step ladder 300. Step ladder 300 includes rails 302 and 304, as well as deep section steps 306 and 308. First step engagement means 40 is shown in engagement with step 308. As such, the step 308 is disposed within the step receiving recess defined by the gap separating the concave upward sloping surface 42 and the container bottom. Tabs 52 and 54 are shown engaging the bottom surface of step 306. As was the case in FIG. 2, the first step engagement means 40, would also have been sufficient to securely attach the tray 10 to the ladder 300, as the step 308 would provide sufficiently large surface for the secure attachment of the first step engagement means to the step.

Also shown in FIG. 3 is a paint roller including a roller brush 72, a handle 74, and a handle grip 76. The handle 74 is disposed within the paint roller receiving slot 64 on the handle 60. The paint roller is shown disposed within the container 20 with the roller brush disposed on the roller surface 36.

Using the ladder supported holding tray 10 is simple. If desired, the paint basin 46 of the container can be filled with paint before attachment to a ladder. The container bottom lower surface 32 and the bottom surface of the first step engagement means provide the tray with a stable base to support the tray of a flat surface. The tray does not require any extra support when filling the container paint basin 46 as it is very stable when supported on a flat surface. Once filled, the user can easily lift the tray 10 by the handle 60 and proceed up the ladder.

Once the user has determined the location on the ladder where the tray will be attached, the user needs only to slide the rung, set of rungs, or step into the step receiving recess separating the first step engagement means and the container bottom. To slide the tray 10 onto a rung, set of rungs, or step, the user need only to slightly tilt the tray so that the leading edge of the step engagement means will pass under the step. At the same time, the user moves the tray toward the ladder until the rung, set of rungs, or step are as far into the step receiving recess as possible. At this point, the first step engagement means has hooked under the rung, set of rungs, or step. The user then allows the weight of the tray to rotate the tray forward in relation to the first step. The rotation will continue until the second step engagement means contacts the next higher rung or step. At this point, the tray is securely attached to the ladder and the user can release the handle. At no time during the attachment of the tray to the ladder does the user have to reposition his or her hand on the handle. Additionally, the other hand of the user is not required for mounting the tray, so the user can maintain a firm hand hold on the ladder.

Releasing the tray from the step or set of rungs is as easy as securing the tray to a step or set of rungs. The user needs only to grab the handle and then pull the tray away from the ladder while slightly tilting the tray to release the step engagement means from the step, rung, or set of rungs.

Once secured to a ladder the tray is extremely stable. The tray is essentially locked on to the ladder and resists all movement in relation to the ladder. There is little chance of accidentally knocking the tray off the ladder as releasing the tray from the ladder requires the tray to be simultaneously tilted slightly and moved away from the ladder. The tray also resists side to side movement well and resists upward or downward movement as the container portion of the tray rides above the step while the step engagement means rides below the step. Filling the tray with paint or supplies once the tray is secured to a ladder is easy due to the stability of the tray attachment to the ladder. The ladder supported holding tray 10 is typically manufactured to be narrower than the typical ladder so that there is plenty of hand room between the side panels of the tray and the side rails of the ladder.

The ladder supported holding tray is easily manufactured using existing plastic molding techniques. The tray could be produced as a single piece or as multiple pieces that require a small degree of assembly. The tray container could be manufactured in a variety of sizes or shapes.

Although the tray of the preferred version of the invention as shown in FIGS. 1 to 3 is shown designed to accommodate a paint roller, the tray could be configured to accommodate other tools or hardware that could be used while on a ladder. It is also understood that various modifications and changes in form or detail could readily be made without departing from the spirit of the invention. It is therefore intended that the invention be not limited to the exact form and detail herein shown and describe, nor to anything less than the whole of the invention herein disclosed and as hereinafter claimed.

We claim:

1. A tray assembly for releasable attachment to a ladder comprising:

an open top container including at least a front panel, a back panel, a first side panel, a second side panel, and a bottom joined together to define a hollow interior receptacle;

at least one first step engagement means disposed on the container proximate to the container bottom to permit secure temporary engagement to a first step of the ladder;

at least one second step engagement means disposed on the tray assembly proximate to the open top of the container to permit secure temporary engagement to a second step of the ladder above the first step;

wherein the second step engagement means contacts only the bottom surface of the second step.

2. The tray assembly of claim 1, wherein the first step engagement means once engaged to a step positions the container substantially proximate to that step and additionally positions the first step engagement means substantially below that step.

3. The tray assembly of claim 1, wherein the side panels, back and front panels include a top lip defining an upper rim of the open top container, and wherein the second step engagement means comprises tabs disposed on the top lip of both side panels for engaging the bottom surface of a second step.

4. The tray assembly of claim 1, wherein the container bottom comprises at least a lower surface and an inclined rolling surface higher than the lower surface;

wherein the lower surface is proximate to the bottom of the front panel; and, wherein the rolling surface is proximate to the bottom of the back panel.

5. The tray assembly of claim 4, wherein the first step engagement means include a flat bottom surface that is coplanar with the container bottom lower-surface for providing the tray assembly stability when placed on a flat surface.

6. The tray assembly of claim 4, wherein the container above the lower surface and beneath the rolling surface defines a paint basin.

7. The tray assembly of claim 1, wherein each first step engagement means includes an upward sloping surface configured to releasably engage and securely hook onto a step from underneath the step.

8. The tray assembly of claim 7, wherein the upward sloping surface is also concave.

9. The tray assembly of claim 7, wherein the tray assembly includes a pair of first step engagement means, and wherein each first step engagement means originate at a position on the container proximate to the center of the container bottom and extend therefrom to a position proximate the back panel of the container.

10. The tray assembly of claim 9, wherein the first step engagement means are separated from the container bottom by a step receiving recess defined by a gap between the container bottom and the upward sloping surface of the first step engagement means, wherein the gap is slightly larger that the thickness of a step which is received into the recess for securely positioning the tray assembly on that step.

11. The tray assembly of claim 1, wherein the first step engagement means permits secure temporary engagement to a first step of a ladder that may comprise a step of a step ladder, a single rung of an extension ladder, or side by side rungs of overlapping sections of an extension ladder; and, wherein the second step engagement means permits secure temporary engagement to a second step that may comprise a step of a step ladder, or a rung of an extension ladder.

12. The tray assembly of claim 3, additionally including a tray handle disposed between the first and second side panels proximate to the top lip of the side panels and intermediate the front panel and the back panel.

13. The tray assembly of claim 12, wherein the tray handle additionally includes paint roller engagement means for engaging a handle of a paint roller that is disposed within the container.

14. The tray assembly of claim 13, wherein the paint roller engagement means comprises paint roller handle receiving slots on the tray handle that permit a paint roller handle to be temporarily secured to the tray assembly.

15. A tray assembly for releasable attachment to a step ladder or to an extension ladder comprising:

an open top container including at least a front panel, a back panel, a first side panel, an second side panel, and a bottom joined together to define a hollow interior receptacle;

first step engagement means disposed on the container proximate to the container bottom to permit secure temporary engagement of the tray to a first step of a step ladder, to a first single rung of an extension ladder, or to first side by side rungs of overlapping sections of an extension ladder;

second step engagement means disposed on the tray assembly proximate to the open top of the container to permit secure temporary engagement to a second step of a step ladder, a second single rung of an extension ladder, or a second rung of side by side rungs of overlapping sections of an extension ladder;

wherein the second step engagement means contacts only the bottom surface of a second step or rung.

* * * * *